US010795287B2

(12) United States Patent
Suzuki et al.

(10) Patent No.: US 10,795,287 B2
(45) Date of Patent: Oct. 6, 2020

(54) IMAGE FORMING APPARATUS INCLUDING A REMOVABLE INTERMEDIATE TRANSFER UNIT WITH A GUIDE PORTION THAT DOES NOT PROTRUDE OUTWARD FROM THE INTERMEDIATE TRANSFER UNIT IN A DIRECTION ORTHOGONAL TO A REMOVAL DIRECTION

(71) Applicant: KONICA MINOLTA, INC., Chiyoda-ku, Tokyo (JP)

(72) Inventors: Yuta Suzuki, Toyokawa (JP); Yusuke Hashimoto, Anjo (JP); Teruo Nagashima, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/653,121

(22) Filed: Oct. 15, 2019

(65) Prior Publication Data

US 2020/0125008 A1 Apr. 23, 2020

(30) Foreign Application Priority Data

Oct. 17, 2018 (JP) ..... 2018-195594

(51) Int. Cl.
*G03G 15/16* (2006.01)

(52) U.S. Cl.
CPC ..... *G03G 15/161* (2013.01)

(58) Field of Classification Search
CPC ..... G03G 15/161; G03G 21/168
USPC ..... 399/121
See application file for complete search history.

(56) References Cited

U.S. PATENT DOCUMENTS 9,057,990 B2 * 6/2015 Yamaguchi ..... G03G 21/168
9,846,404 B2 * 12/2017 Shikata et al. ..... G03G 21/168

FOREIGN PATENT DOCUMENTS

JP 2000275987 A 10/2000

* cited by examiner

*Primary Examiner* — William J Royer
(74) *Attorney, Agent, or Firm* — Holtz, Holtz & Volek PC

(57) ABSTRACT

An image forming apparatus includes an apparatus main body and an intermediate transfer unit including an intermediate transfer belt, the intermediate transfer unit being provided as being attachable to and removable from the apparatus main body by sliding movement in a first direction. The apparatus main body includes a main body-side guide portion for guiding the intermediate transfer unit along the first direction. The intermediate transfer unit includes a side frame including a frame portion extending like a frame with the first direction being defined as a longitudinal direction thereof, the side frame being provided adjacently to the intermediate transfer belt in a second direction orthogonal to the first direction, and a unit-side guide portion to be engaged with the main body-side guide portion. The unit-side guide portion is provided not to protrude outward relative to the frame portion in the second direction.

8 Claims, 14 Drawing Sheets

IMAGE FORMING APPARATUS INCLUDING A REMOVABLE INTERMEDIATE TRANSFER UNIT WITH A GUIDE PORTION THAT DOES NOT PROTRUDE OUTWARD FROM THE INTERMEDIATE TRANSFER UNIT IN A DIRECTION ORTHOGONAL TO A REMOVAL DIRECTION

The entire disclosure of Japanese Patent Application No. 2018-195594 filed on Oct. 17, 2018 is incorporated herein by reference in its entirety.

BACKGROUND

Technological Field

The present invention relates to an image forming apparatus.

Description of the Related Art

For example, Japanese Laid-Open Patent Publication No. 2000-275987 discloses in connection with a conventional image forming apparatus, an image forming apparatus including a transfer unit attachable to and removable from an apparatus main body. The transfer unit includes a transfer belt, a drive roller, a driven roller, and a tension roller, as well as a pair of side plates which pivotally support the drive roller, the driven roller, and the tension roller. The pair of side plates are provided with a pair of left and right guide pins protruding laterally from the side plates. A guide rail with which the guide pins are engaged is provided on an inner side of front and rear frames of the apparatus main body.

SUMMARY

In the image forming apparatus disclosed in Japanese Laid-Open Patent Publication No. 2000-275987 described above, the pair of side plates are provided with the guide pins for guiding the transfer unit in attachment and removal of the transfer unit to and from the apparatus main body. Since the guide pins are provided protruding laterally from the side plates, a length of the transfer unit in an axial direction of the drive roller, the driven roller, and the tension roller is long. Consequently, the image forming apparatus may be increased in size.

An object of the present invention is to solve the problem above and to provide an image forming apparatus which achieves a reduction in size.

To achieve at least one of the abovementioned objects, according to an aspect of the present invention, an image forming apparatus includes an apparatus main body and an intermediate transfer unit including an intermediate transfer belt, the intermediate transfer unit being provided as being attachable to and removable from the apparatus main body by sliding movement in a first direction. The apparatus main body includes a main body-side guide portion configured to guide the intermediate transfer unit along the first direction in attachment and removal of the intermediate transfer unit to and from the apparatus main body. The intermediate transfer unit includes a side frame including a frame portion extending like a frame with the first direction being defined as a longitudinal direction, the side frame being provided adjacently to the intermediate transfer belt in a second direction orthogonal to the first direction, and a unit-side guide portion engaged with the main body-side guide portion. The unit-side guide portion is provided not to protrude outward relative to the frame portion in the second direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
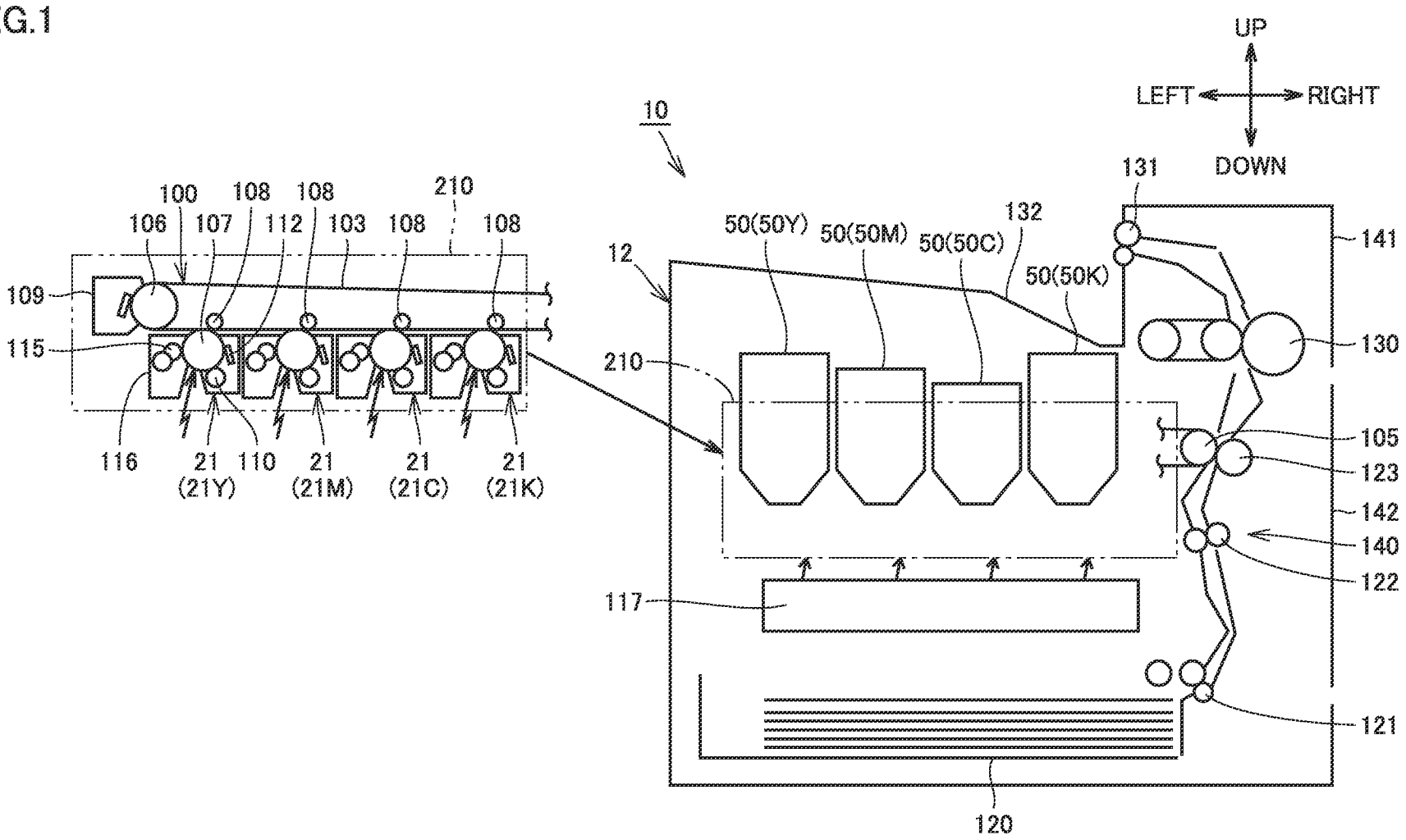
FIG. 1 is a cross-sectional view showing an internal structure of an image forming apparatus in an embodiment of the present invention.

Hereinafter, one or more embodiments of the present invention will be described with reference to the drawings. However, the scope of the invention is not limited to the disclosed embodiments. In the drawings referred to below, the same or corresponding members have the same reference numerals allotted.

FIG. 1 is a cross-sectional view showing an internal structure of an image forming apparatus in an embodiment of the present invention. Referring to FIG. 1, an image forming apparatus 10 in the present embodiment is a color image forming apparatus capable of forming a full-color image. An overall structure of image forming apparatus 10 will initially be described.

Image forming apparatus 10 includes a plurality of imaging units 21 (21Y, 21M, 21C, 21K), an intermediate transfer unit 100, a plurality of toner accommodation containers 50 (50Y, 50M, 50C, 50K), an optical writing device 117, a transportation portion 140, a paper feed tray 120, a paper ejection tray 132, and a cabinet 141.

Intermediate transfer unit 100 includes an intermediate transfer belt 103, a drive roller 105, a driven roller 106, a plurality of transfer rollers 108, and a cleaning unit 109.

Drive roller 105 and driven roller 106 are provided at a distance from each other. Intermediate transfer belt 103 is annularly arranged as being wound around drive roller 105 and driven roller 106. As drive roller 105 is rotationally driven, intermediate transfer belt 103 circulates counter-clockwise in FIG. 1. Driven roller 106 is rotated as following circulation of intermediate transfer belt 103.

Imaging unit 21 is provided below intermediate transfer unit 100. A tandem type image forming apparatus 10 is adopted in which imaging units 21Y, 21M, 21C, and 21K are disposed along intermediate transfer belt 103.

The plurality of transfer rollers 108 are provided on an inner side of annularly arranged intermediate transfer belt 103. The plurality of transfer rollers 108 are provided as being opposed to the plurality of imaging units 21 (21Y, 21M, 21C, 21K), respectively. Transfer roller 108 is provided as primary transfer means.

Cleaning unit 109 is provided on an outer side of annularly arranged intermediate transfer belt 103. Cleaning unit 109 is provided adjacently to driven roller 106. Cleaning unit 109 is provided as cleaning means for cleaning intermediate transfer belt 103.

Imaging units 21Y, 21M, 21C, and 21K form toner images in respective colors of yellow (Y), magenta (M), cyan (C), and black (K) on a surface of intermediate transfer belt 103. The toner images in colors of yellow (Y), magenta (M), cyan (C), and black (K) are superimposed on one another on the surface of intermediate transfer belt 103.

Imaging units 21Y, 21M, 21C, and 21K are basically identical except for the difference in color they handle.

Each imaging unit 21 includes a photoconductor drum 107, a charging roller 110 as charging means, a development unit 116, and a cleaning blade 112. Charging roller 110, development unit 116, transfer roller 108, and cleaning blade 112 are provided on an outer circumference of photoconductor drum 107 as being aligned in a circumferential direction thereof.

Development unit 116 includes a development roller 115. Development roller 115 is arranged as being opposed to photoconductor drum 107. A developer composed of toner and a magnetic carrier is restricted to a prescribed thickness of a developer layer by a restriction blade and carried on development roller 115.

The plurality of toner accommodation containers 50 (50Y, 50M, 50C, 50K) are provided in correspondence with the plurality of imaging units 21 (21Y, 21M, 21C, 21K), respectively. Toner accommodation container 50 accommodates a developer with which development unit 116 is replenished.

The plurality of toner accommodation containers 50 (50Y, 50M, 50C, 50K) are provided in front of the plurality of imaging units 21 (21Y, 21M, 21C, 21K) and intermediate transfer unit 100. FIG. 1 shows an area behind the plurality of toner accommodation containers 50 (50Y, 50M, 50C, 50K) (an area surrounded by a chain double dotted line 210) separately from an apparatus main body 12 for the sake of convenience of illustration.

Optical writing device 117 is provided below the plurality of imaging units 21 (21Y, 21M, 21C, 21K). Paper feed tray 120 is provided below optical writing device 117. Paper as a recording medium is loaded in paper feed tray 120. Transportation portion 140 is provided laterally to the plurality of imaging units 21 (21Y, 21M, 21C, 21K) and paper feed tray 120.

Transportation portion 140 includes a paper feed roller 121, a registration roller 122, a transfer roller 123, a fixing apparatus 130, and a paper ejection roller 131. Transfer roller 123 is provided as secondary transfer means. Transfer roller 123 is arranged as being opposed to drive roller 105 with intermediate transfer belt 103 being interposed. Transportation portion 140 transports paper loaded in paper feed tray 120 to paper ejection tray 132 through a secondary transfer portion between intermediate transfer belt 103 and transfer roller 123 and through fixing apparatus 130.

A color toner image formed on intermediate transfer belt 103 is moved to the secondary transfer portion between intermediate transfer belt 103 and transfer roller 123. Paper loaded in paper feed tray 120 is transported to the secondary transfer portion between intermediate transfer belt 103 and transfer roller 123 by paper feed roller 121 and registration roller 122. The color toner image carried on intermediate transfer belt 103 is transferred to a surface of paper in the secondary transfer portion. The color toner image is fixed to the surface of paper as the paper is heated and pressurized in fixing apparatus 130. The paper having the image formed through the process above is ejected to paper ejection tray 132 by paper ejection roller 131.

Cabinet 141 serves as a housing which defines an appearance of image forming apparatus 10. Cabinet 141 includes a side door 142. Side door 142 is provided in a side surface of cabinet 141. Side door 142 is provided as being opposed to transportation portion 140 in a lateral direction. Side door 142 is mainly opened and closed when a paper jam occurs in transportation portion 140 or intermediate transfer unit 100 is serviced.

Figure 2:
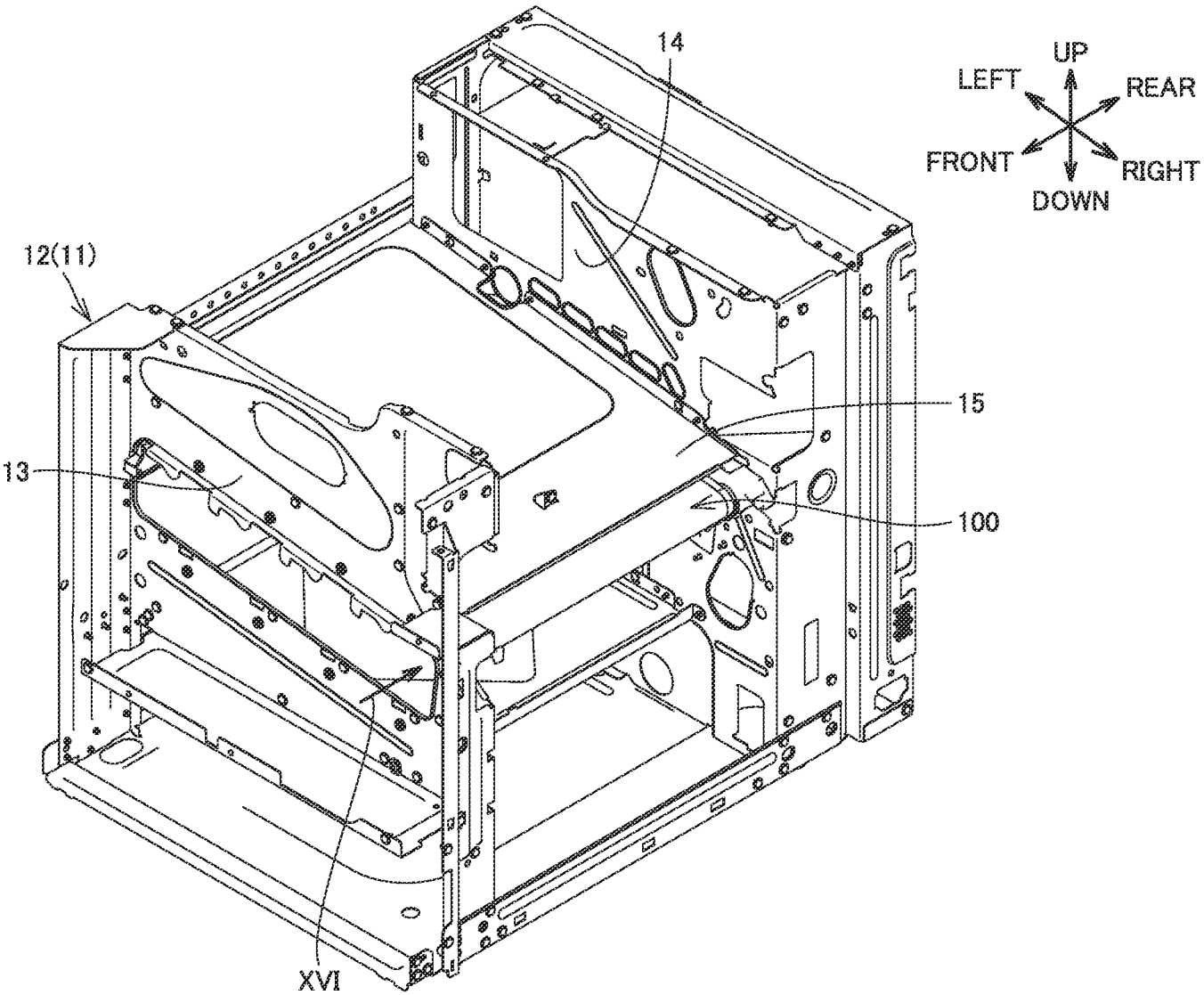
FIG. 2 is a perspective view showing a main body frame provided in a cabinet in FIG. 1 (with an intermediate transfer unit being attached).
Figure 3:
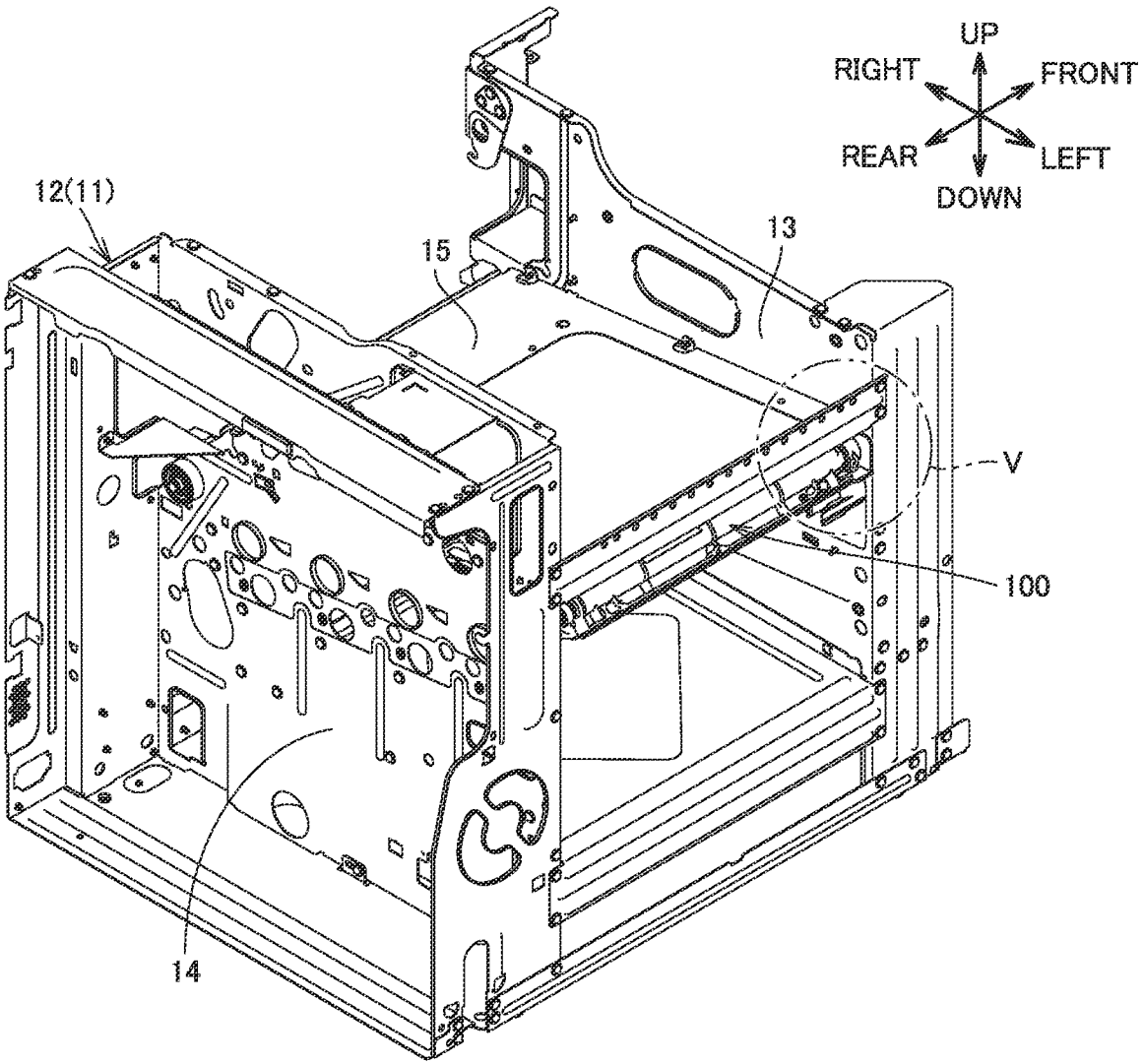
FIG. 3 is another perspective view showing the main body frame provided in the cabinet in FIG. 1 (with the intermediate transfer unit being attached).
Figure 4:
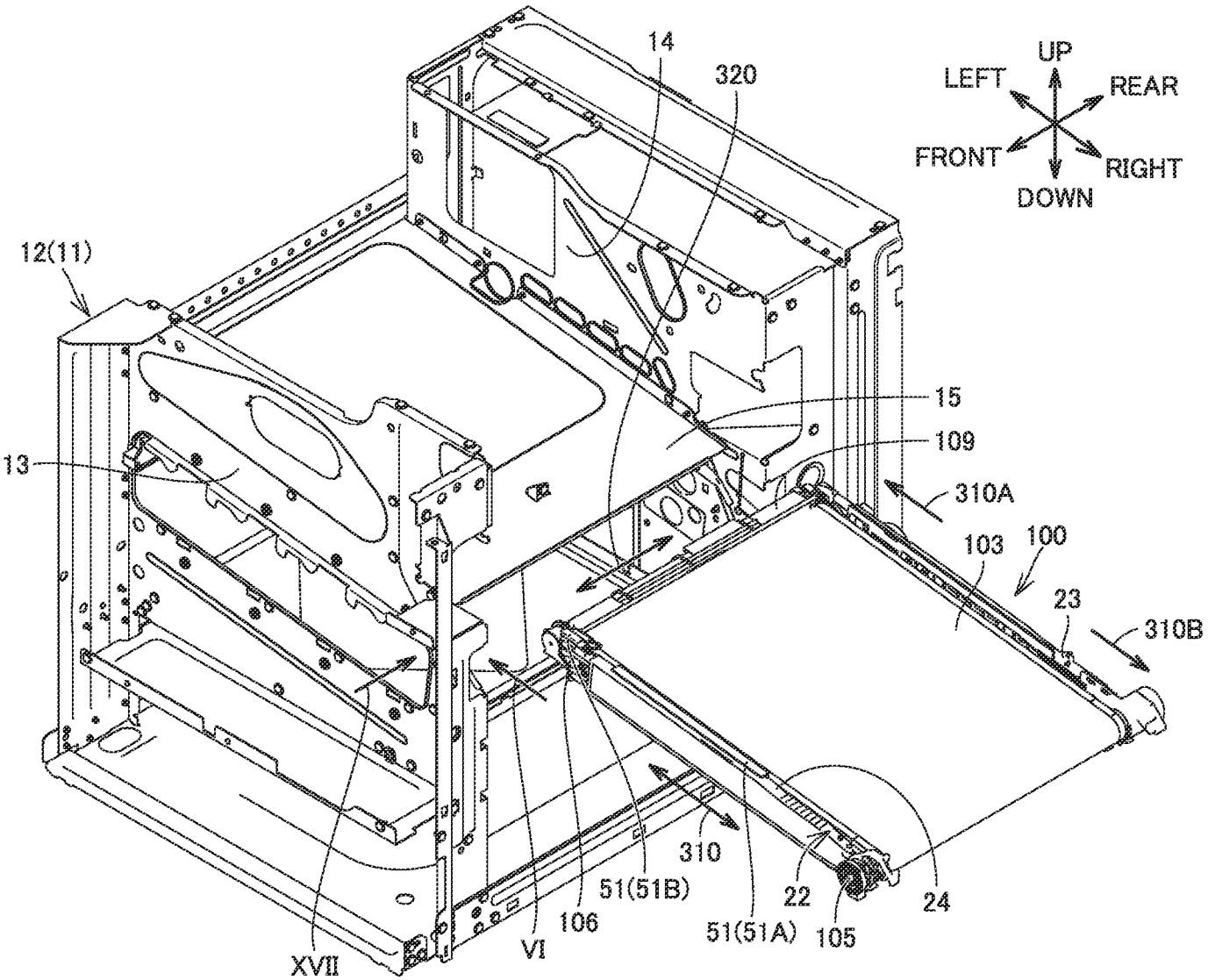
FIG. 4 is a perspective view showing the main body frame provided in the cabinet in FIG. 1 (with the intermediate transfer unit not being attached).

A structure for attachment and removal of intermediate transfer unit 100 will now be described. FIGS. 2 and 3 are perspective views showing a main body frame 11 provided in the cabinet 141 in FIG. 1 (with the intermediate transfer unit 100 being attached). FIG. 4 is a perspective view showing the main body frame 11 provided in the cabinet 141 in FIG. 1 (with the intermediate transfer unit 100 not being attached).

Referring to FIGS. 2 to 4, image forming apparatus 10 includes apparatus main body 12. Apparatus main body 12 is a portion which defines a main body of image forming apparatus 10. Apparatus main body 12 includes cabinet 141 and a main body frame 11 which defines a skeleton inside cabinet 141.

Main body frame 11 includes a front frame 13, a rear frame 14, and an intermediate plate 15. Front frame 13 and rear frame 14 are erected along a vertical direction. Front frame 13 and rear frame 14 are arranged at a distance from each other in a front-rear direction. Intermediate plate 15 is arranged along a horizontal direction. Intermediate plate 15 bridges front frame 13 and rear frame 14. Intermediate plate 15 is connected to front frame 13 and rear frame 14 at opposing ends in the front-rear direction.

Intermediate transfer unit 100 is provided as being attachable to and removable from apparatus main body 12 by sliding movement in a first direction.

Intermediate transfer unit 100 is attached to and removed from apparatus main body 12 by sliding movement in the first direction (a direction along the lateral direction shown with an arrow 310 in FIG. 4). Intermediate transfer unit 100 is attached to apparatus main body 12 by sliding movement in one direction (a direction shown with an arrow 310A in FIG. 4) along the first direction. Intermediate transfer unit 100 is removed from apparatus main body 12 by sliding movement in a reverse direction (a direction shown with an arrow 310B in FIG. 4) along the first direction.

While intermediate transfer unit 100 is attached to apparatus main body 12, intermediate transfer unit 100 is arranged between front frame 13 and rear frame 14. Intermediate transfer unit 100 is arranged directly under intermediate plate 15.

A side in the sliding direction for attachment of intermediate transfer unit 100 (a side in a direction shown with arrow 310A in FIG. 4) is herein referred to as a "rearward side along the first direction" and a side in the sliding direction for removal of intermediate transfer unit 100 (a side in a direction shown with arrow 310B in FIG. 4) is referred to as a "frontward side along the first direction."

Figure 5:
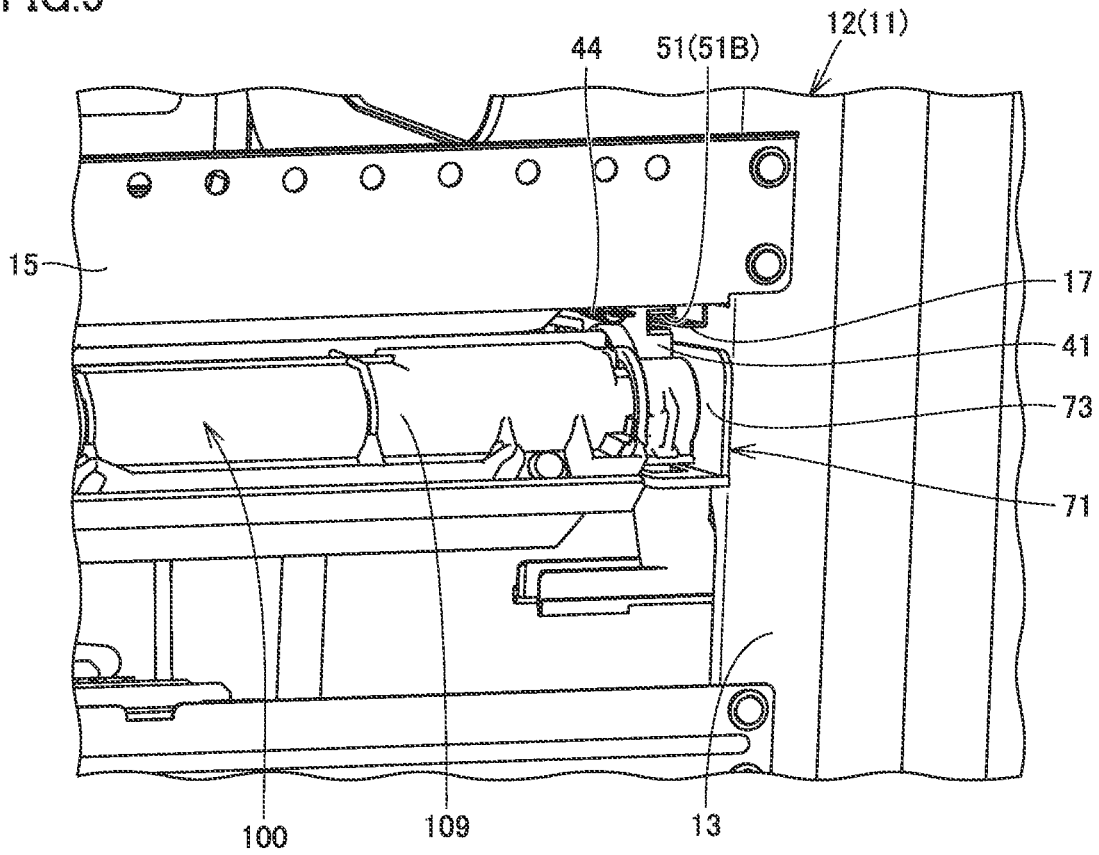
FIG. 5 is a perspective view showing an apparatus main body and the intermediate transfer unit within an area surrounded by a chain double dotted line V in FIG. 3.
Figure 6:
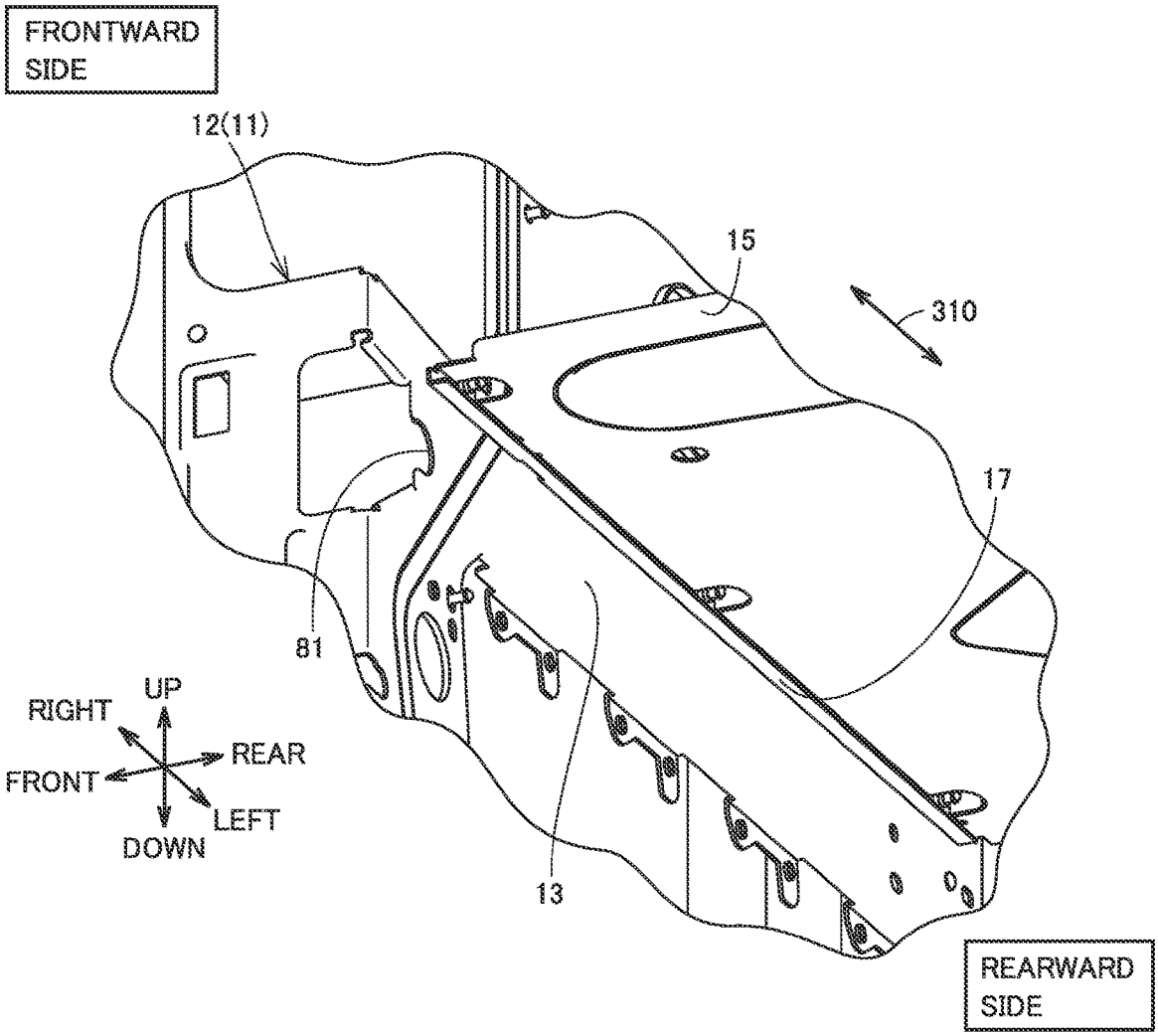
FIG. 6 is a perspective view showing the apparatus main body in a direction shown with an arrow VI in FIG. 4.

FIG. 5 is a perspective view showing the apparatus main body 12 and the intermediate transfer unit 100 within an area surrounded by a chain double dotted line V in FIG. 3. FIG. 6 is a perspective view showing the apparatus main body 12 viewed in a direction shown with an arrow VI in FIG. 4.

Referring to FIGS. 4 to 6, apparatus main body 12 includes a main body-side guide portion 17. Main body-side guide portion 17 guides intermediate transfer unit 100 along the first direction (the direction shown with arrow 310 in FIG. 4) in attachment and removal of intermediate transfer unit 100 to and from apparatus main body 12.

Main body-side guide portion 17 is in a shape of a rib extending along the first direction. Main body-side guide portion 17 is provided in main body frame 11. Main body-side guide portion 17 is provided directly under intermediate plate 15. Main body-side guide portion 17 is provided in a corner portion defined by front frame 13 and intermediate plate 15. Main body-side guide portion 17 is constructed in such a manner that a front end of intermediate plate 15 is folded back inward from below.

Figure 7:
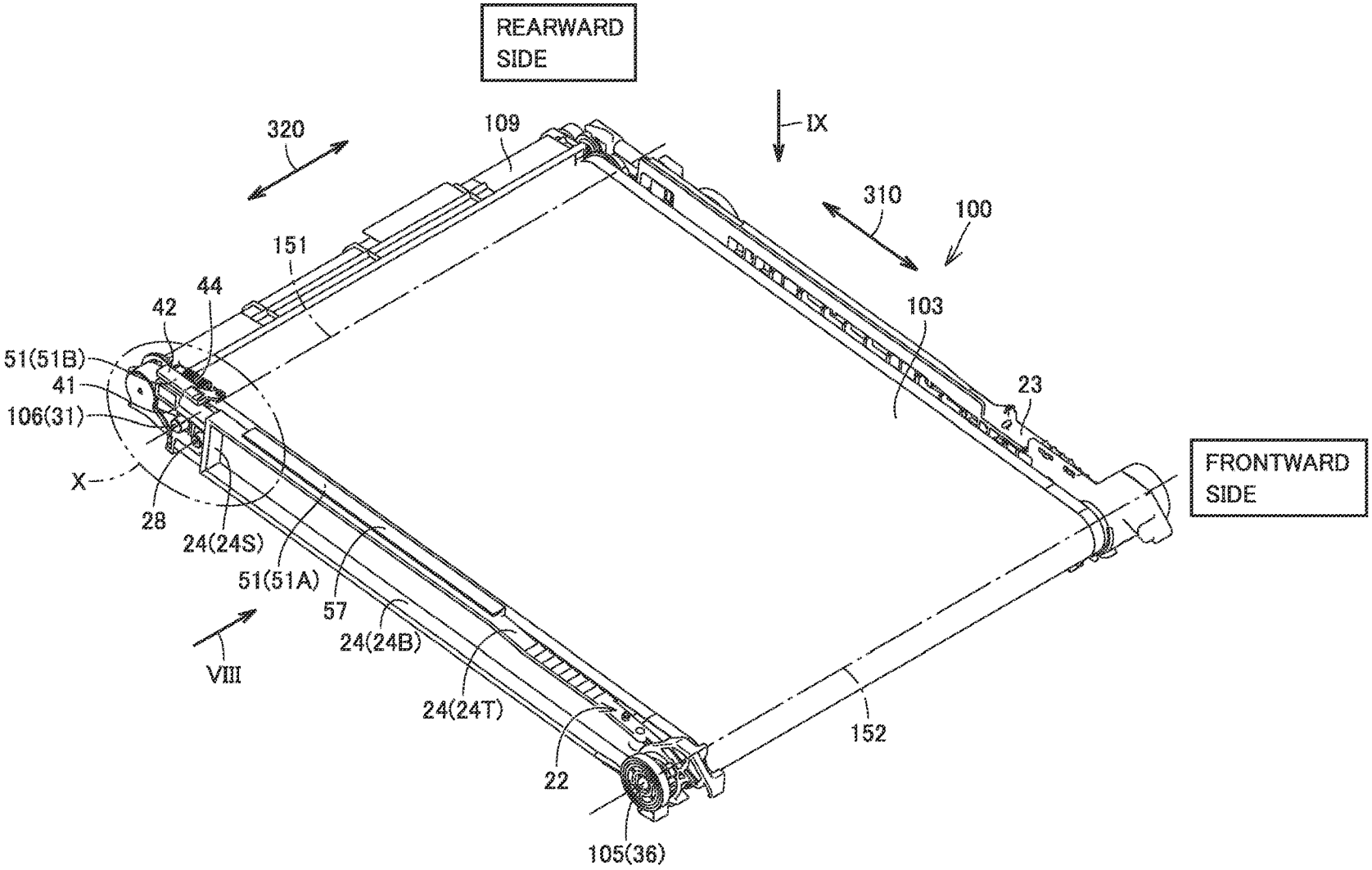
FIG. 7 is a perspective view showing the intermediate transfer unit.
Figure 8:
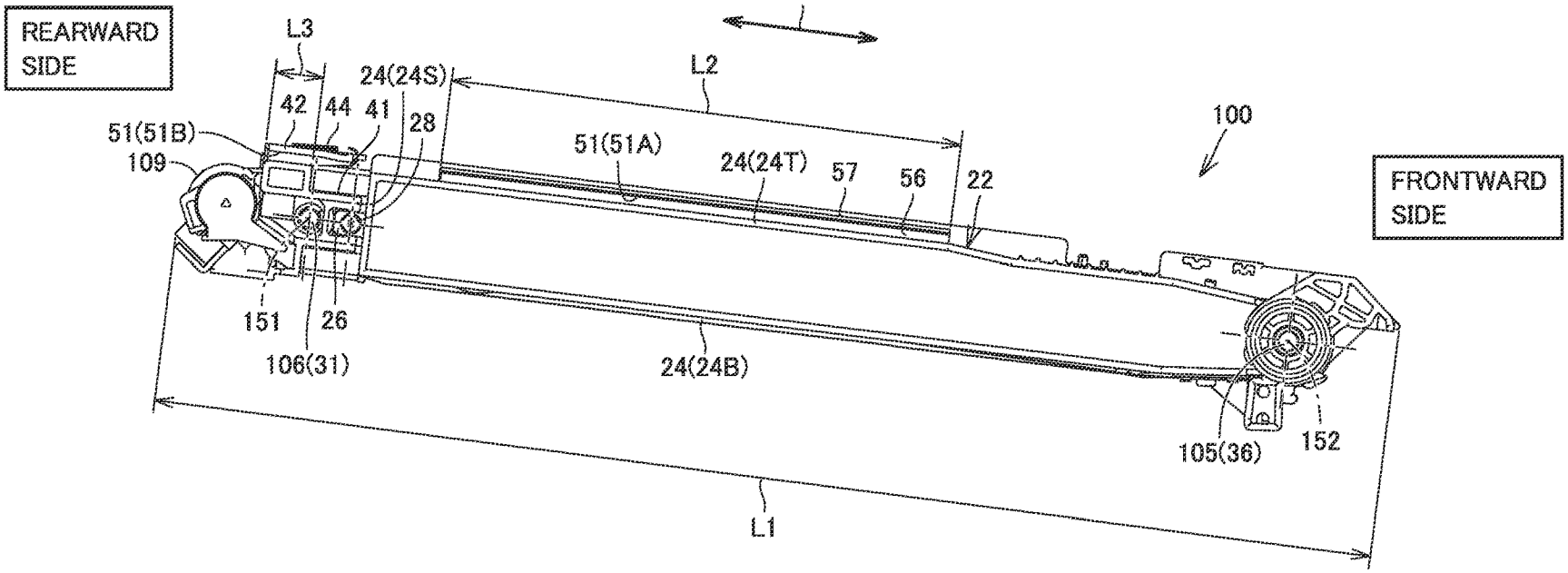
FIG. 8 is a front view showing the intermediate transfer unit viewed in a direction shown with an arrow VIII in FIG. 7.
Figure 9:
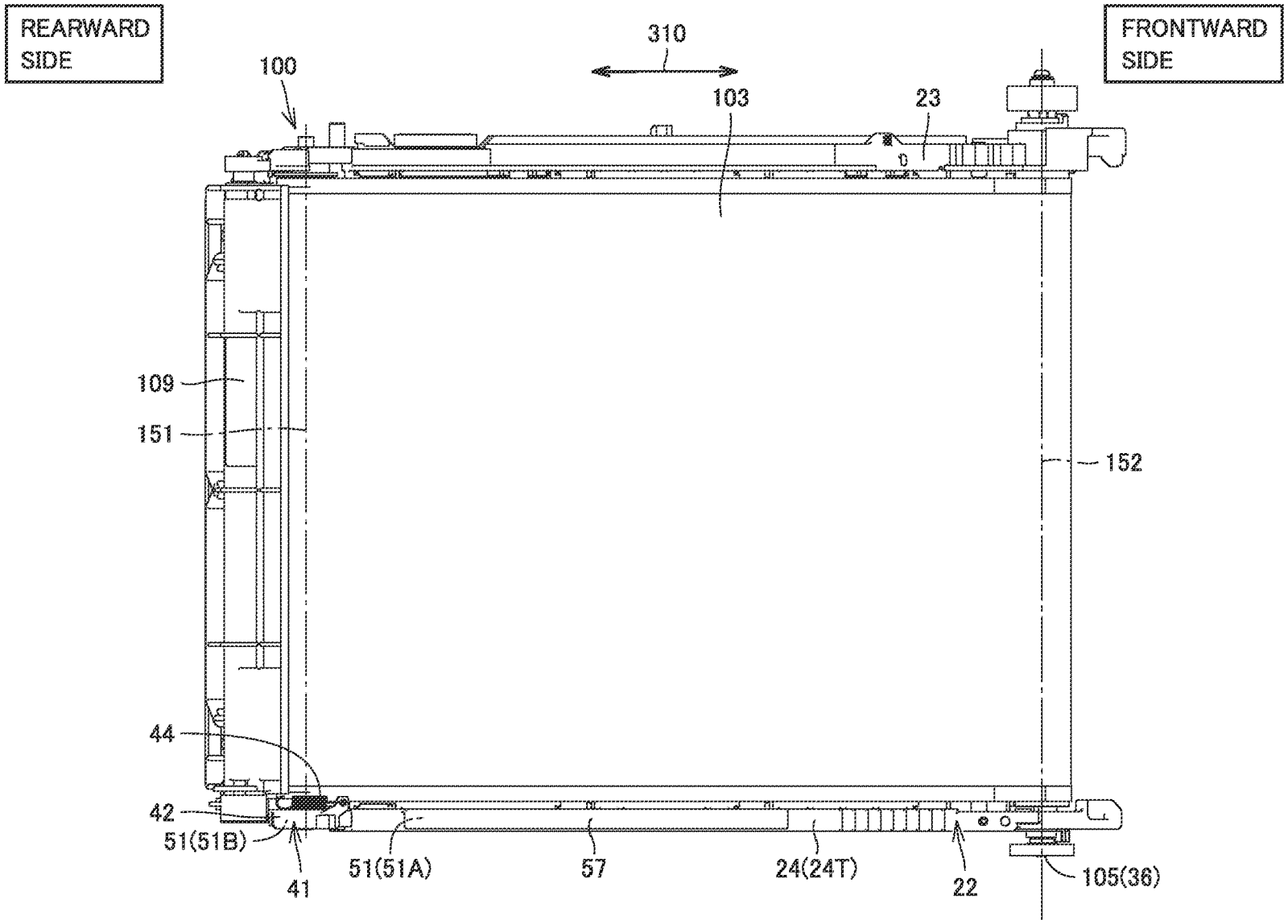
FIG. 9 is a top view showing the intermediate transfer unit viewed in a direction shown with an arrow IX in FIG. 7.

A more specific structure of intermediate transfer unit 100 will now be described. FIG. 7 is a perspective view showing the intermediate transfer unit 100. FIG. 8 is a front view showing the intermediate transfer unit 100 viewed in a direction shown with an arrow VIII in FIG. 7. FIG. 9 is a top view showing the intermediate transfer unit 100 viewed in a direction shown with an arrow IX in FIG. 7.

Referring to FIGS. 7 to 9, driven roller 106 is provided as being rotatable around a central axis 151. Central axis 151 is a virtual straight line extending in a second direction (a direction shown with an arrow 320 in FIG. 7) orthogonal to the first direction (a direction shown with arrow 310 in FIG. 7). Intermediate transfer belt 103 is wound around driven roller 106 on the rearward side along the first direction.

Drive roller 105 is provided as being rotatable around a central axis 152. Central axis 152 is a virtual straight line extending in the second direction. Intermediate transfer belt 103 is wound around drive roller 105 on the frontward side along the first direction. Drive roller 105 is provided at an end of intermediate transfer unit 100 on the frontward side along the first direction.

Driven roller 106 includes a driven roller shaft 31. Driven roller shaft 31 is in a shape of a shaft extending along central axis 151. Driven roller shaft 31 is rotatably supported at opposing ends in the second direction.

Drive roller 105 includes a drive roller shaft 36. Drive roller shaft 36 is in a shape of a shaft extending along central axis 152. Drive roller shaft 36 is rotatably supported at opposing ends in the second direction. Rotation of a motor is transmitted to drive roller shaft 36 through a power transmission mechanism such as a toothed belt. Drive roller shaft 36 is arranged on the frontward side along the first direction relative to driven roller shaft 31.

Cleaning unit 109 is in an elongated shape with the second direction being defined as its longitudinal direction. Cleaning unit 109 is provided at an end of intermediate transfer unit 100 on the rearward side along the first direction. Driven roller 106 is provided adjacently to cleaning unit 109 on the frontward side along the first direction.

Intermediate transfer unit 100 includes a side frame 22. Side frame 22 is provided adjacently to intermediate transfer belt 103 in the second direction. Side frame 22 is arranged at an end (an end on a front side) of intermediate transfer unit 100 in the second direction. While intermediate transfer unit 100 is attached to apparatus main body 12, side frame 22 is opposed to front frame 13 in the second direction (reference is to be made to FIGS. 2 to 4 together).

A side where intermediate transfer belt 103 is located when viewed from side frame 22 is herein referred to as an "inner side in the second direction" and a side opposite to the side where intermediate transfer belt 103 is located when viewed from side frame 22 is referred to as an "outer side in the second direction."

Side frame 22 includes a frame portion 24. Frame portion 24 extends like a frame with the first direction being defined as its longitudinal direction. Frame portion 24 is in a shape of a frame which makes an elongated loop with the first direction being defined as its longitudinal direction when viewed in the second direction. Frame portion 24 has a band shape extending by a prescribed width in the second direction.

Frame portion 24 includes a top portion 24T, a bottom portion 24B, and a side portion 24S. Top portion 24T is provided above bottom portion 24B. Top portion 24T and bottom portion 24B are arranged at a distance from each other in the vertical direction. Top portion 24T and bottom portion 24B extend frontward from the rearward side along the first direction and are connected to each other at an end on the frontward side along the first direction. Side portion 24S extends between top portion 24T and bottom portion 24B on the rearward side along the first direction. Side portion 24S extends along the vertical direction, and is connected to top portion 24T at its upper end and connected to bottom portion 24B at its lower end. Side portion 24S is located on the frontward side along the first direction relative to central axis 151.

Though side frame 22 is in such a shape that the inside of frame portion 24 is open in the present embodiment (a structure in the rear of the inner side of frame portion 24 is not shown in the drawings), limitation thereto is not intended and side frame 22 may be in such a shape that the inner side of frame portion 24 is closed.

Figure 10:
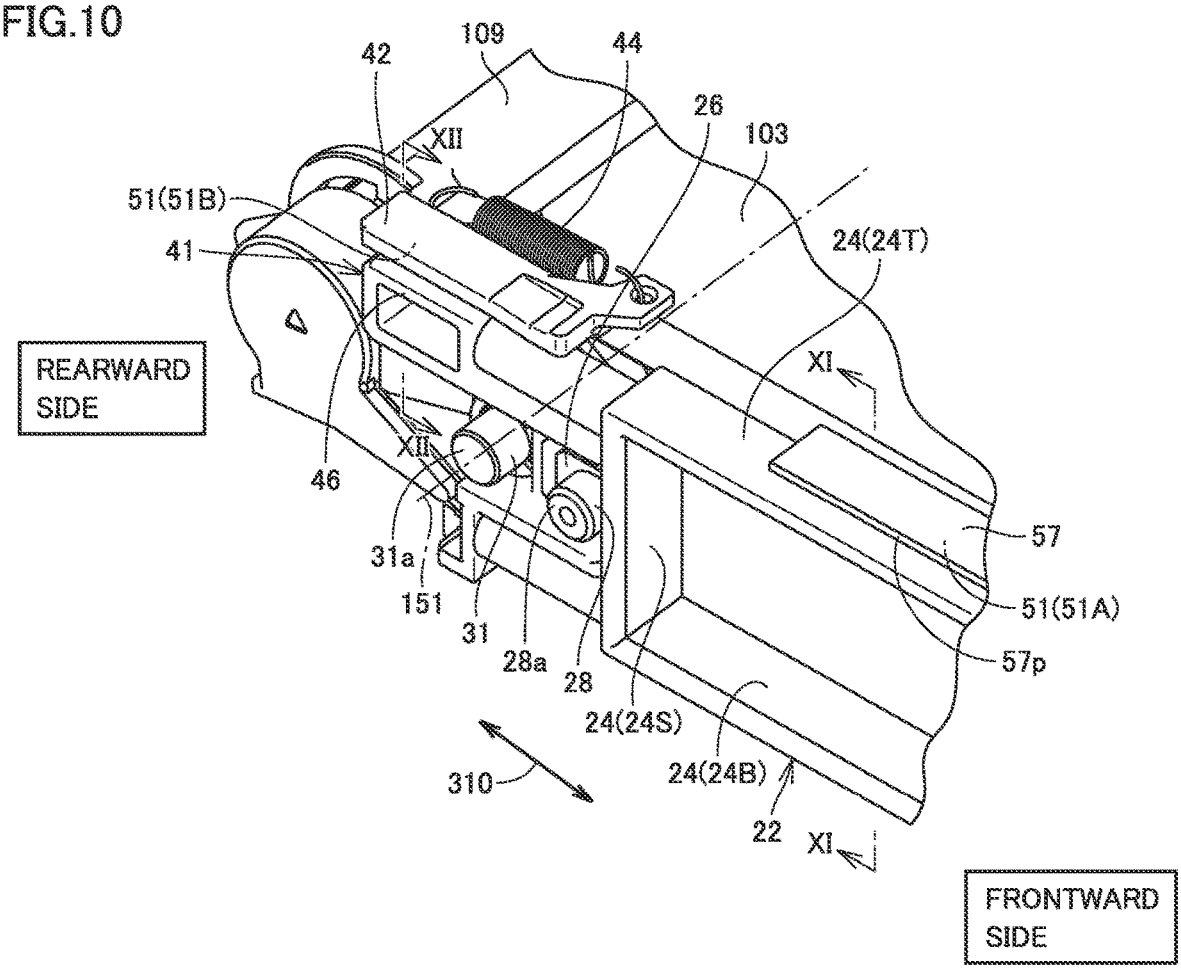
FIG. 10 is a perspective view showing the intermediate transfer unit within an area surrounded by a chain double dotted line X in FIG. 7.

FIG. 10 is a perspective view showing the intermediate transfer unit 100 within an area surrounded by a chain double dotted line X in FIG. 7. Referring to FIGS. 7 to 10, intermediate transfer unit 100 further includes a bracket 41.

Bracket 41 is provided at an end (an end on the front side) of intermediate transfer unit 100 in the second direction. Bracket 41 is provided between side frame 22 and cleaning unit 109 in the first direction when viewed in the second direction. Bracket 41 is provided on central axis 151. Bracket 41 is provided adjacently to side frame 22 (side portion 24S) on the rearward side in the first direction.

Bracket 41 is connected to side frame 22. Bracket 41 rotatably supports driven roller shaft 31 and drive roller shaft 36 together with side frame 22. Bracket 41 elastically supports cleaning unit 109 with an elastic spring 44 being interposed.

Referring to FIGS. 5 to 10, intermediate transfer unit 100 further includes a unit-side guide portion 51 (51A, 51B). Unit-side guide portion 51 is engaged with main body-side guide portion 17. Unit-side guide portion 51 extends along the first direction. Unit-side guide portion 51 is in a shape of a groove with which main body-side guide portion 17 in the shape of the rib is engaged.

Unit-side guide portion 51A and unit-side guide portion 51B are provided as being aligned in the first direction. Unit-side guide portion 51A and unit-side guide portion 51B are provided at a distance from each other in the first direction. Unit-side guide portion 51A is located on the frontward side along the first direction and unit-side guide portion 51B is located on the rearward side along the first direction.

Figure 11:
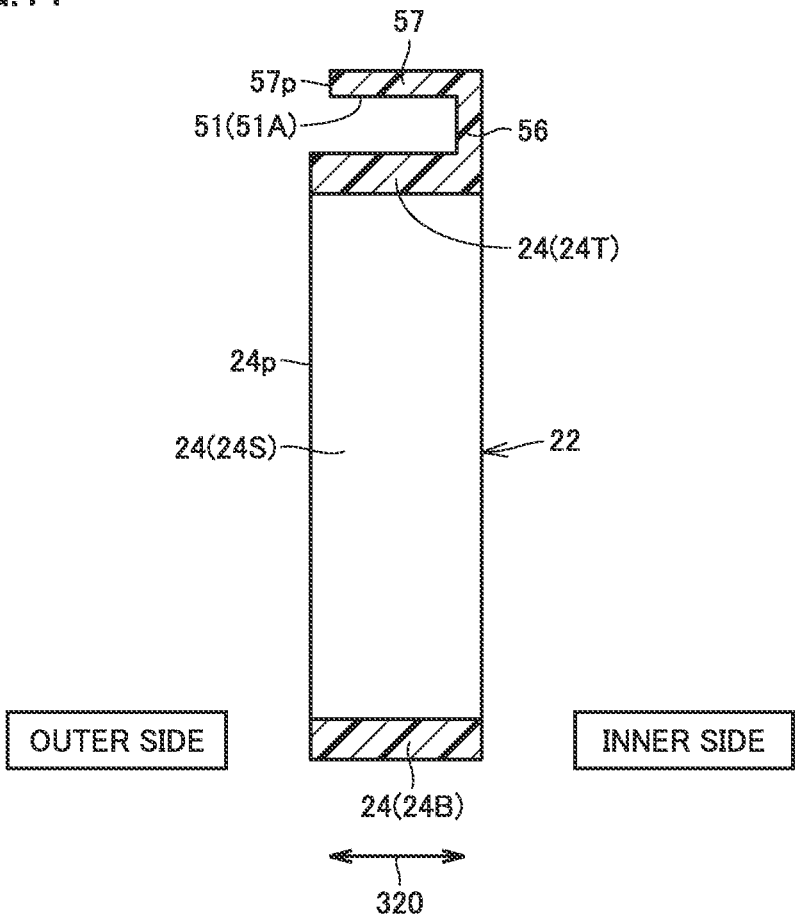
FIG. 11 is a cross-sectional view showing the intermediate transfer unit viewed in a direction along the line XI-XI in FIG. 10.
Figure 12:
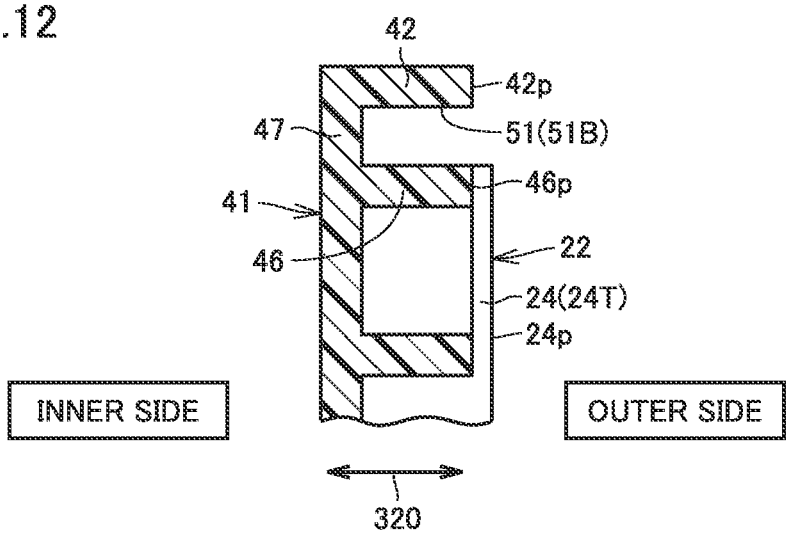
FIG. 12 is a cross-sectional view showing the intermediate transfer unit viewed in a direction along the line XII-XII in FIG. 10.

FIG. 11 is a cross-sectional view showing the intermediate transfer unit 100 viewed in a direction along the line XI-XI in FIG. 10. FIG. 12 is a cross-sectional view showing the intermediate transfer unit 100 viewed in a direction along the line XII-XII in FIG. 10.

Referring to FIGS. 5 to 12, unit-side guide portion 51A is provided integrally with side frame 22. Unit-side guide portion 51A is provided above frame portion 24 (top portion 24T).

Unit-side guide portion 51A includes a vertical plate portion 56 and a lateral plate portion 57. Vertical plate portion 56 extends upward from top portion 24T and extends along the first direction. Lateral plate portion 57 extends outward in the second direction from an upper end of vertical plate portion 56 and extends along the first direction. Lateral plate portion 57 is arranged at a distance from top portion 24T in the vertical direction. Lateral plate portion 57 defines, together with top portion 24T and vertical plate portion 56, a shape of a groove which opens outward in the second direction and extends along the first direction.

Unit-side guide portion 51B is provided integrally with bracket 41. Bracket 41 includes a base portion 46, an erected portion 47, and an elastic spring attachment portion 42.

Base portion 46 is in a shape of a rib extending along the first direction, and extending by a prescribed width in the second direction. Erected portion 47 is in a shape of a wall which rises upward from base portion 46. Elastic spring attachment portion 42 extends outward in the second direction from an upper end of erected portion 47. Elastic spring attachment portion 42 is arranged at a distance from base portion 46 in the vertical direction. Elastic spring 44 is attached to elastic spring attachment portion 42. Elastic spring attachment portion 42 defines, together with base portion 46 and erected portion 47, a shape of a groove which opens outward in the second direction and extends along the first direction.

As main body-side guide portion 17 in the shape of the rib and unit-side guide portion 51 (51A, 51B) in the shape of the groove are engaged with each other in attachment and removal of intermediate transfer unit 100 to and from apparatus main body 12, intermediate transfer unit 100 is guided along the first direction.

As shown in FIG. 8, unit-side guide portion 51 (51A, 51B) may have a total length (L2+L3) in the first direction not shorter than half a total length (L1) of intermediate transfer unit 100 in the first direction. In this case, intermediate transfer unit 100 can be guided along the first direction in a more stable manner.

Referring to FIGS. 10 to 12, unit-side guide portion 51 (51A, 51B) is provided not to protrude outward relative to frame portion 24 in the second direction.

More specifically, in unit-side guide portion 51A, vertical plate portion 56 and lateral plate portion 57 are provided not to protrude outward relative to frame portion 24 in the second direction. Frame portion 24 includes a tip end 24*p* at an outer tip end in the second direction. Lateral plate portion 57 includes a tip end 57*p* at an outer tip end in the second direction. Tip end 57*p* of lateral plate portion 57 is located on the inner side in the second direction relative to tip end 24*p* of frame portion 24 (see FIG. 11).

In unit-side guide portion 51B, base portion 46, erected portion 47, and elastic spring attachment portion 42 are provided not to protrude outward relative to frame portion 24 in the second direction. Base portion 46 includes a tip end 46*p* at an outer tip end in the second direction. Elastic spring attachment portion 42 includes a tip end 42*p* at an outer tip end in the second direction. Tip end 46*p* of base portion 46 and tip end 42*p* of elastic spring attachment portion 42 are located on the inner side in the second direction relative to tip end 24*p* of frame portion 24 (see FIG. 12).

In the present embodiment, since unit-side guide portion 51 (51A, 51B) is provided not to protrude outward relative to frame portion 24 in the second direction, a length of intermediate transfer unit 100 in the second direction (a direction of a rotation axis of drive roller 105 and driven roller 106) can be suppressed. Since front frame 13 and rear frame 14 can be arranged more closely to each other on the side of apparatus main body 12, image forming apparatus 10 can be reduced in size.

A position of tip end 57*p* of lateral plate portion 57 in the second direction may be aligned with a position of tip end 24*p* of frame portion 24 in the second direction. The positions of tip end 46*p* of base portion 46 and tip end 42*p* of elastic spring attachment portion 42 in the second direction may be aligned with the position of tip end 24*p* of frame portion 24 in the second direction.

Figure 13:
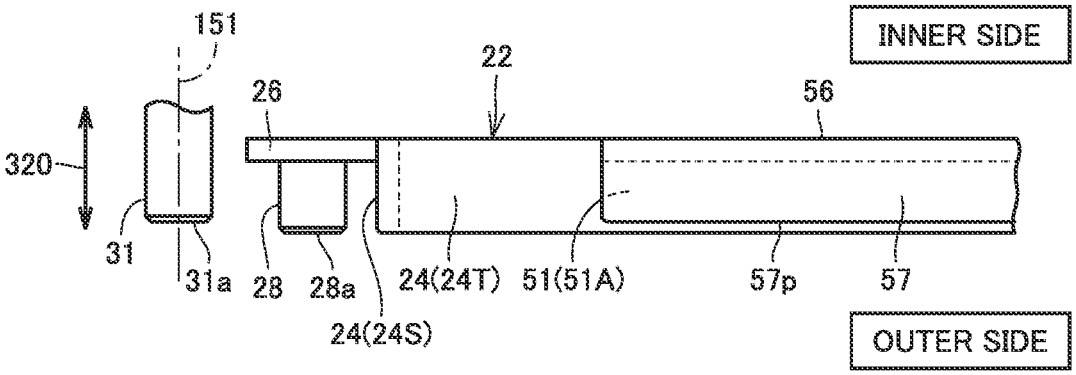
FIG. 13 is a top view showing positional relation among a frame portion, a boss portion, and a driven roller shaft in a second direction.

FIG. 13 is a top view showing positional relation among the frame portion 24, a boss portion 28, and the driven roller shaft 31 in the second direction. Referring to FIGS. 8, 10, and 13, side frame 22 further includes a boss portion 28. Though detailed description will be given later, boss portion 28 is provided for positioning of intermediate transfer unit 100 with respect to apparatus main body 12.

Boss portion 28 is in a shape of a shaft extending along the second direction. Boss portion 28 is provided as being aligned with driven roller shaft 31 in the first direction. Boss portion 28 is provided between frame portion 24 (side portion 24S) and driven roller shaft 31 in the first direction. Boss portion 28 is connected to frame portion 24 (side portion 24S) with an extension portion 26 being interposed.

Driven roller shaft 31 is provided not to protrude outward relative to frame portion 24 in the second direction. Driven roller shaft 31 includes an end surface 31*a* at an outer tip end in the second direction. End surface 31*a* of driven roller shaft 31 is located on the inner side in the second direction relative to tip end 24*p* of frame portion 24.

Boss portion 28 is provided not to protrude outward relative to frame portion 24 in the second direction. Boss portion 28 includes an end surface 28*a* at an outer tip end in the second direction. A position of end surface 28*a* of boss portion 28 in the second direction is aligned with the position of tip end 24*p* of frame portion 24 in the second direction.

A position of end surface 31*a* of driven roller shaft 31 in the second direction may be aligned with the position of tip end 24*p* of frame portion 24 in the second direction. End surface 28*a* of boss portion 28 may be located on the inner side in the second direction relative to tip end 24*p* of frame portion 24.

According to such a construction, a length of intermediate transfer unit 100 in the second direction can be prevented from being longer due to driven roller shaft 31 and boss portion 28. Image forming apparatus 10 can thus more reliably be reduced in size.

Figure 14:
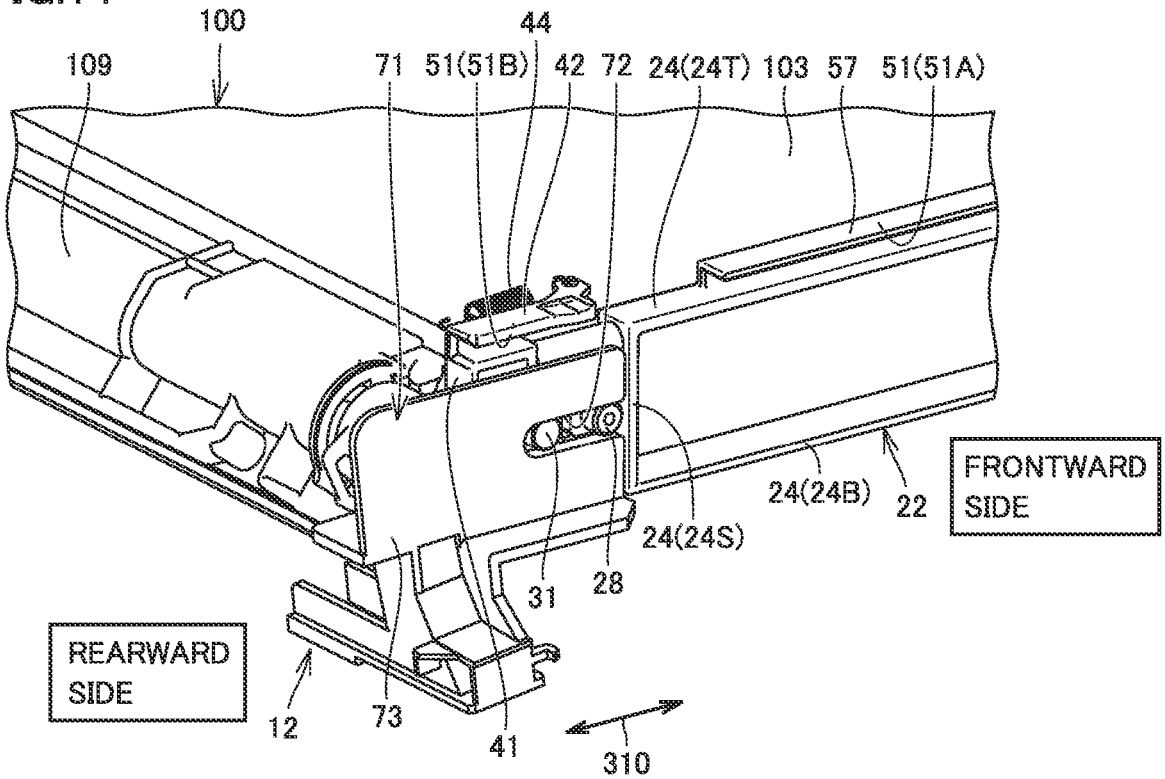
FIG. 14 is a perspective view showing a state of attachment of the intermediate transfer unit to the apparatus main body (positioning member).
Figure 15:
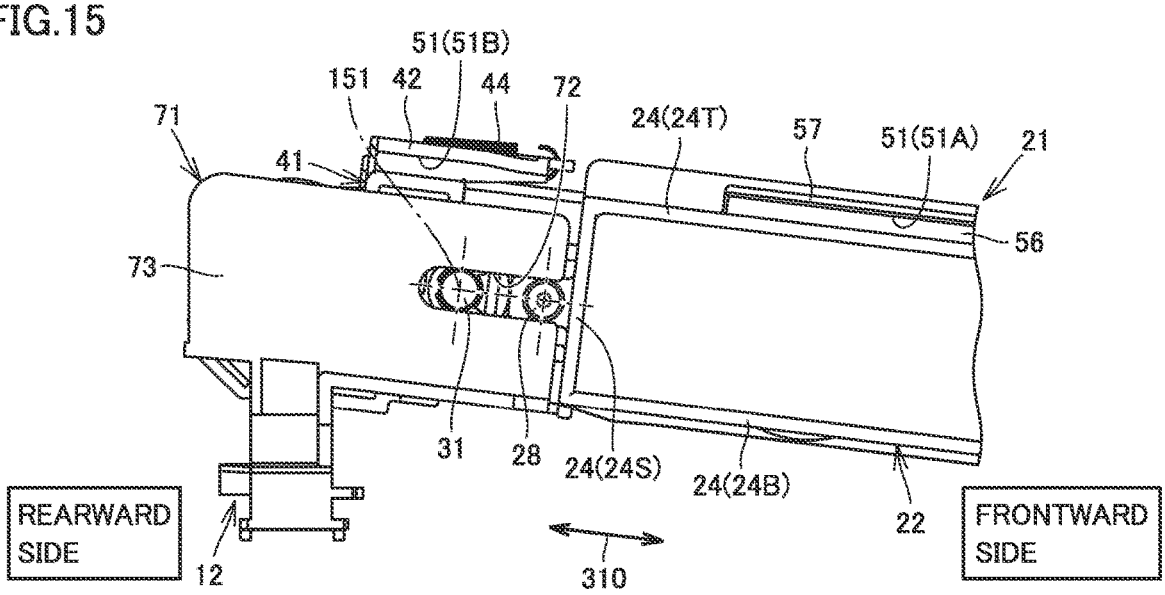
FIG. 15 is a front view showing the state of attachment of the intermediate transfer unit to the apparatus main body (positioning member).

FIG. 14 is a perspective view showing a state of attachment of the intermediate transfer unit 100 to the apparatus main body 12 (positioning member 71). FIG. 15 is a front view showing the state of attachment of the intermediate transfer unit 100 to the apparatus main body 12 (positioning member 71).

Referring to FIGS. 5, 10, 14, and 15, apparatus main body 12 further includes a positioning member 71. Positioning member 71 is attached to main body frame 11. Positioning member 71 is attached to front frame 13 on the rearward side along the first direction.

Positioning member 71 includes a flat plate portion 73. Flat plate portion 73 is in a form of a flat plate with the second direction being defined as its direction of thickness. Flat plate portion 73 is superimposed on front frame 13 in a portion directly under intermediate plate 15.

A first opening 72 is provided in apparatus main body 12 (positioning member 71). First opening 72 is defined by an opening which passes through flat plate portion 73 in the direction of thickness. First opening 72 is in a shape of an elongated hole with the first direction being defined as its longitudinal direction. First opening 72 opens on the frontward side along the first direction. While intermediate transfer unit 100 is attached to apparatus main body 12, driven roller shaft 31 and boss portion 28 are inserted in first opening 72. Driven roller shaft 31 and boss portion 28 abut on an edge of first opening 72 in the vertical direction.

According to such a construction, while intermediate transfer unit 100 is attached to apparatus main body 12, intermediate transfer unit 100 can accurately be positioned with respect to apparatus main body 12.

Figure 16:
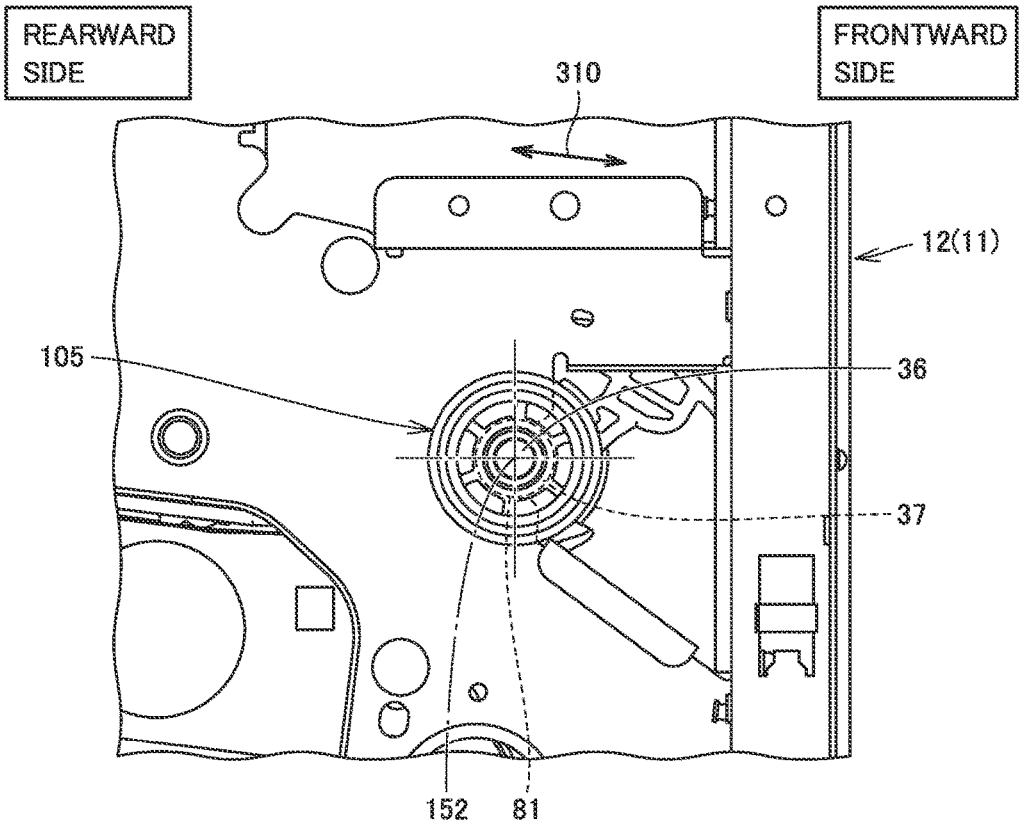
FIG. 16 is a front view showing the apparatus main body and the intermediate transfer unit viewed in a direction shown with an arrow XVI in FIG. 2.
Figure 17:
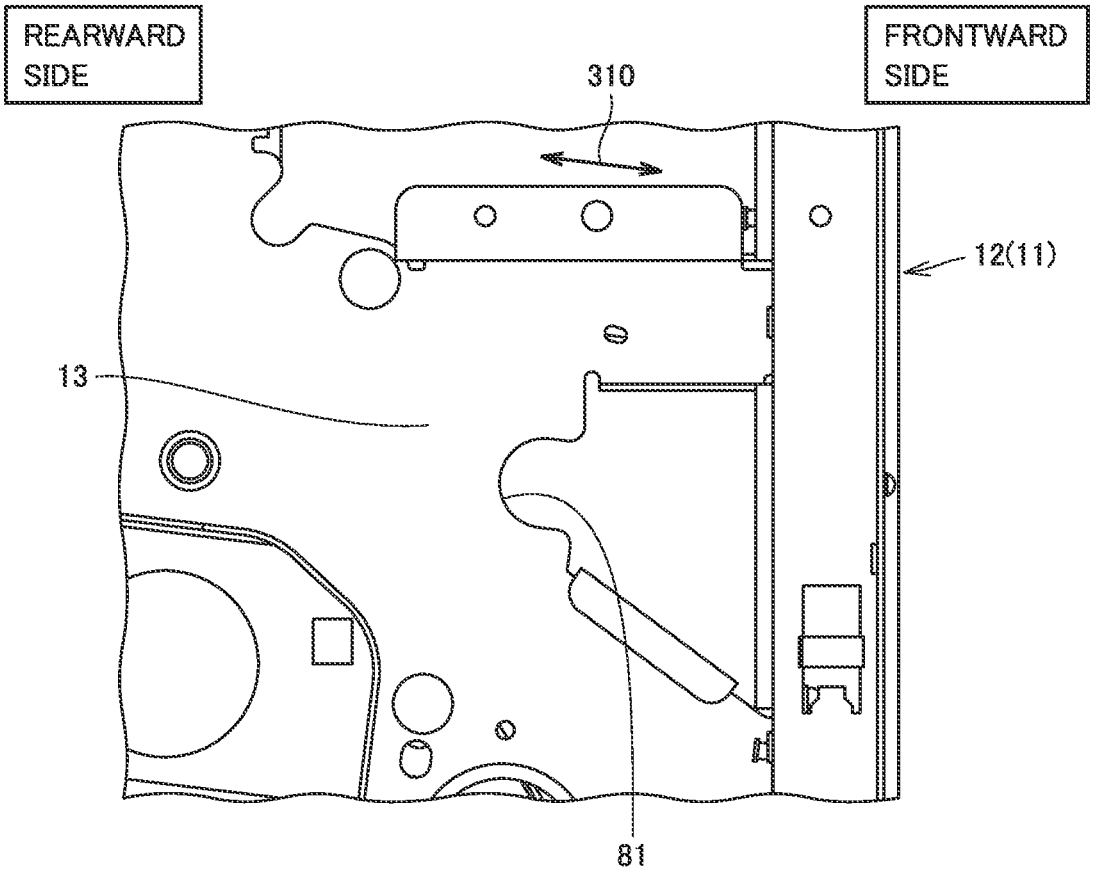
FIG. 17 is a front view showing the apparatus main body (with the intermediate transfer unit not being attached) viewed in a direction shown with an arrow XVII in FIG. 4.

FIG. 16 is a front view showing the apparatus main body 12 and the intermediate transfer unit 100 viewed in a direction shown with an arrow XVI in FIG. 2. FIG. 17 is a front view showing the apparatus main body 12 (with the intermediate transfer unit 100 not being attached) viewed in a direction shown with an arrow XVII in FIG. 4.

Referring to FIGS. 6, 16, and 17, apparatus main body 12 (main body frame 11) is further provided with a second opening 81. Second opening 81 is provided in front frame 13. Second opening 81 is provided at a site on the frontward side along the first direction in front frame 13. Second opening 81 opens on the frontward side along the first direction.

While intermediate transfer unit 100 is attached to apparatus main body 12, drive roller shaft 36 is inserted in second opening 81. Drive roller shaft 36 is opposed to an edge of second opening 81 on the rearward side along the first direction. More specifically, drive roller 105 further includes a drive roller shaft receiver 37. Drive roller shaft receiver 37 is fitted to drive roller shaft 36. Drive roller shaft receiver 37 abuts on the edge of second opening 81 on the rearward side along the first direction.

According to such a construction, while intermediate transfer unit 100 is attached to apparatus main body 12, intermediate transfer unit 100 can accurately be positioned in the first direction with respect to apparatus main body 12.

As shown in FIGS. 7 and 9, intermediate transfer unit 100 includes a side frame 23 paired with side frame 22. Side frame 23 is arranged at an end (an end on a rear side) of intermediate transfer unit 100 in the second direction. Side frame 23 may include a guide mechanism similar to or different from that of side frame 22 described above.

A structure of image forming apparatus 10 in the embodiment of the present invention will be summarized. Image forming apparatus 10 in the present embodiment includes apparatus main body 12 and intermediate transfer unit 100 including intermediate transfer belt 103, intermediate transfer unit 100 being provided as being attachable to and removable from apparatus main body 12 by sliding movement in the first direction (the direction shown with arrow 310). Apparatus main body 12 includes main body-side guide portion 17 configured to guide intermediate transfer unit 100 along the first direction in attachment and removal of intermediate transfer unit 100 to and from apparatus main body 12. Intermediate transfer unit 100 includes side frame 22 including frame portion 24 extending like a frame with the first direction being defined as the longitudinal direction, side frame 22 being provided adjacently to intermediate transfer belt 103 in the second direction (the direction shown with arrow 320) orthogonal to the first direction, and unit-side guide portion 51 (51A, 51B) to be engaged with main body-side guide portion 17. Unit-side guide portion 51 (51A, 51B) is provided not to protrude outward relative to frame portion 24 in the second direction.

According to image forming apparatus 10 in the embodiment of the present invention thus constructed, a length of intermediate transfer unit 100 in the second direction can be suppressed and image forming apparatus 10 can be reduced in size.

The construction of the image forming apparatus described above and functions and effects achieved by the image forming apparatus are summarized as below.

An image forming apparatus includes an apparatus main body and an intermediate transfer unit including an intermediate transfer belt, the intermediate transfer unit being provided as being attachable to and removable from the apparatus main body by sliding movement in a first direction. The apparatus main body includes a main body-side guide portion configured to guide the intermediate transfer unit along the first direction in attachment and removal of the intermediate transfer unit to and from the apparatus main body. The intermediate transfer unit includes a side frame including a frame portion extending like a frame with the first direction being defined as a longitudinal direction, the side frame being provided adjacently to the intermediate transfer belt in a second direction orthogonal to the first direction, and a unit-side guide portion to be engaged with the main body-side guide portion. The unit-side guide portion is provided not to protrude outward relative to the frame portion in the second direction.

According to the image forming apparatus thus constructed, the unit-side guide portion is provided not to protrude outward relative to the frame portion of the side frame in the second direction. Therefore, a length of the intermediate transfer unit in the second direction can be suppressed. The image forming apparatus can thus be reduced in size.

Preferably, the intermediate transfer unit further includes a driven roller shaft extending along the second direction. The driven roller shaft is provided not to protrude outward relative to the frame portion in the second direction.

According to the image forming apparatus thus constructed, a length of the intermediate transfer unit in the second direction can be prevented from being longer due to the driven roller shaft. The image forming apparatus can thus more effectively be reduced in size.

Preferably, the apparatus main body is provided with a first opening in a shape of an elongated hole with the first direction being defined as the longitudinal direction, the first opening on a frontward side along the first direction. The side frame further includes a boss portion in a shape of a shaft extending along the second direction, the boss portion being provided as being aligned with the driven roller shaft in the first direction, the boss portion being inserted in the first opening together with the driven roller shaft.

According to the image forming apparatus thus constructed, as the driven roller shaft and the boss portion are inserted in the first opening, the intermediate transfer unit attached to the apparatus main body can be positioned.

Preferably, the boss portion is provided not to protrude outward relative to the frame portion in the second direction.

According to the image forming apparatus thus constructed, a length of the intermediate transfer unit in the second direction can be prevented from being longer due to the boss portion for positioning of the intermediate transfer unit. The image forming apparatus can thus more effectively be reduced in size.

Preferably, the intermediate transfer unit further includes a drive roller shaft arranged on a frontward side along the first direction relative to the driven roller shaft, the drive roller shaft extending along the second direction. The apparatus main body is provided with a second opening which opens on the frontward side along the first direction. The drive roller shaft is inserted in the second opening and opposed to an edge of the second opening on a rearward side along the first direction.

According to the image forming apparatus thus constructed, the intermediate transfer unit attached to the apparatus main body can be positioned in the first direction as the drive roller shaft is inserted in the second opening and opposed to the edge of the second opening on the rearward side along the first direction.

Preferably, the unit-side guide portion is provided integrally with the side frame.

According to the image forming apparatus thus constructed, the image forming apparatus can be reduced in size while a guide mechanism provided in the intermediate transfer unit is constructed in a simplified manner.

Preferably, the frame portion includes a top portion extending along the first direction. The unit-side guide portion includes a vertical plate portion extending upward from the top portion and extending along the first direction and a lateral plate portion extending outward in the second direction from an upper end of the vertical plate portion, the lateral plate portion extending along the first direction, the lateral plate portion defining a groove shape together with the top portion and the vertical plate portion. The main body-side guide portion is in a shape of a rib extending along the first direction.

According to the image forming apparatus thus constructed, as the unit-side guide portion in a shape of a groove is engaged with the main body-side guide portion in a shape of a rib, the intermediate transfer unit can be guided along the first direction.

Preferably, the unit-side guide portion has a total length in the first direction not shorter than half a total length of the intermediate transfer unit in the first direction.

According to the image forming apparatus thus constructed, the intermediate transfer unit can be guided along the first direction in a more stable manner.

The present invention is applied to an image forming apparatus.

Although embodiments of the present invention have been described and illustrated in detail, the disclosed embodiments are made for the purposes of illustration and example only and not limitation. The scope of the present invention should be interpreted by terms of the appended claims.

What is claimed is:

1. An image forming apparatus comprising:

an apparatus main body; and an intermediate transfer unit including an intermediate transfer belt, the intermediate transfer unit being provided as being attachable to and removable from the apparatus main body by sliding movement in a first direction, the apparatus main body including a main body-side guide portion configured to guide the intermediate transfer unit along the first direction in attachment and removal of the intermediate transfer unit to and from the apparatus main body, the intermediate transfer unit including a side frame including a frame portion extending like a frame with the first direction being defined as a longitudinal direction, the side frame being provided adjacently to the intermediate transfer belt in a second direction orthogonal to the first direction, and a unit-side guide portion to be engaged with the main body-side guide portion, the unit-side guide portion being provided not to protrude outward relative to the frame portion in the second direction.

2. The image forming apparatus according to claim 1, wherein the intermediate transfer unit further includes a driven roller shaft extending along the second direction, and the driven roller shaft is provided not to protrude outward relative to the frame portion in the second direction.

3. The image forming apparatus according to claim 2, wherein the apparatus main body is provided with a first opening in a shape of an elongated hole with the first direction being defined as the longitudinal direction, the first opening on a frontward side along the first direction, and the side frame further includes a boss portion in a shape of a shaft extending along the second direction, the boss portion being provided as being aligned with the driven roller shaft in the first direction, the boss portion being inserted in the first opening together with the driven roller shaft.

4. The image forming apparatus according to claim 3, wherein the boss portion is provided not to protrude outward relative to the frame portion in the second direction.

5. The image forming apparatus according to claim 2, wherein the intermediate transfer unit further includes a drive roller shaft arranged on a frontward side along the first direction relative to the driven roller shaft, the drive roller shaft extending along the second direction, the apparatus main body is provided with a second opening which opens on the frontward side along the first direction, and the drive roller shaft is inserted in the second opening and opposed to an edge of the second opening on a rearward side along the first direction.

6. The image forming apparatus according to claim 1, wherein the unit-side guide portion is provided integrally with the side frame.

7. The image forming apparatus according to claim 6, wherein the frame portion includes a top portion extending along the first direction, the unit-side guide portion includes a vertical plate portion extending upward from the top portion and extending along the first direction, and a lateral plate portion extending outward in the second direction from an upper end of the vertical plate portion, the lateral plate portion extending along the first direction, the lateral plate portion defining a groove shape together with the top portion and the vertical plate portion, and the main body-side guide portion is in a shape of a rib extending along the first direction.

8. The image forming apparatus according to claim 1, wherein the unit-side guide portion has a total length in the first direction not shorter than half a total length of the intermediate transfer unit in the first direction.

* * * * *